United States Patent [19]

Wywialowski

[11] Patent Number: 4,826,095

[45] Date of Patent: May 2, 1989

[54] EXTENDED ROTATION CORE LOADING ARM

[75] Inventor: Frank J. Wywialowski, Beloit, Wis.

[73] Assignee: Beloit Corporation, Beloit, Wis.

[21] Appl. No.: 143,981

[22] Filed: Jan. 13, 1988

[51] Int. Cl.[4] ..... B65H 19/22; B65H 18/20

[52] U.S. Cl. ..... 242/66; 242/56 R

[58] Field of Search ..... 242/66, 65, 56 R, 56.2

[56] References Cited

U.S. PATENT DOCUMENTS

| | | | |
|---|---|---|---|
| 3,284,012 | 11/1966 | Stafford | 242/66 X |
| 4,157,794 | 6/1979 | Brandauer et al. | 242/66 |
| 4,345,722 | 8/1982 | Kuhn | 242/66 X |
| 4,370,193 | 1/1983 | Knauthe | 242/66 X |
| 4,485,979 | 12/1984 | Dropczynski | 242/66 X |
| 4,485,980 | 12/1984 | Gorner | 242/66 X |
| 4,516,735 | 5/1985 | Snygg | 242/66 X |
| 4,576,343 | 3/1986 | Scheuter et al. | 242/66 |

*Primary Examiner*—Stanley N. Gilreath

*Attorney, Agent, or Firm*—Dirk Veneman; Raymond Campbell

[57] ABSTRACT

A rotatable core loading arm for loading cores in a paper winding machine is provided. The rotatable core loading arm includes a primary arm, having a member for holding the core, pivotally coupled to a roll stand of the paper winding machine, a secondary arm coupled to the roll stand, the secondary arm being secured to an actuator for moving the secondary arm and an intermediate link secured to the secondary arm for causing the primary arm to rotate as the secondary arm is moved.

18 Claims, 3 Drawing Sheets

EXTENDED ROTATION CORE LOADING ARM

BACKGROUND OF THE INVENTION

This invention relates generally to apparatus for winding paper and like material. More specifically, this invention relates to the core loading arm of a paper winding device.

Apparatus for winding paper and like material are known in the art. In the paper making industry, these apparatus typically include a core loading arm that functions to load the core or cores, on which the paper or like material is wound, between a pair of rolls so that the paper or like material can be wound therearound.

The winder core loading arms are usually movable from a first position to a second position. The first position is the core loading position and the second position is the position wherein the cores are positioned between the winder rolls. To move the winder core loading arms from the first position to the second position, and vice versa, the arms typically have gear segments fastened to them which are driven by pinion gears mounted to each end on a cross-shaft. The cross-shaft is typically driven by air or an electrical motor coupled to a gear reducer.

Although the prior devices provided a loading arm which functioned to allow one to load the cores between the rolls, their construction has not been entirely satisfactory. First, these traditional winder core loading arms have a bulky construction which limits the operator's access to the front winder drum area preventing adequate clean up of this area. Moreover, in some cases, gear segment teeth failure has been experienced. Furthermore, these winder core loading arms typically have a limited angular rotation of the arm. For example, typical winder core loading arms utilizing linear actuators directly connected to the core loading arms are normally limited to about 120° of rotation. This thereby limits the loading position of the winder core loading arm thereby providing an awkward and sometimes difficult position for the operator to load the cores into the core loading arm.

Accordingly, there is a need for an improved winder core loading arm mechanism.

SUMMARY OF THE INVENTION

The present invention provides a rotatable core loading arm for loading cores in a paper winding machine. The rotatable core loading arm comprises a primary arm including means for holding the cores, the primary arm being pivotally coupled to a roll stand of the paper winding machine, a secondary arm coupled to the roll stand of the paper winding machine and coupled to means for moving the second arm, and an intermediate link means secured to the secondary arm for causing the primary arm to rotate when the second arm is moved by the means for moving.

In an embodiment, the secondary arm is pivotally coupled to the roll stand of the paper winding machine at a first end thereof and coupled to the means for moving at a second end thereof. In the embodiment, the intermediate link means is secured at a first end thereof to the secondary arm and at a second end thereof to the primary arm.

In an embodiment, the secondary arm is pivotally coupled to the primary arm. In the embodiment, the intermediate link means is coupled at one end to the secondary arm and at a second arm to a part of the paper winding machine not including the primary arm.

The primary arm is rotatable from a first position wherein the cores are loaded into the means for holding the cores to a second position wherein the cores are deposited between the winding rolls. Preferably, the first end of the primary arm is moved through an arc of at least approximately 150° when the primary arm is moved from the first position to the second position.

Accordingly, an advantage of the present invention is to provide an extended rotation core loading arm.

An additional advantage of the present invention is that it provides a winder core loading arm that has an extended range of rotation.

A further advantage of the present invention is that it provides a winder core loading arm that has a less bulky construction allowing for easy access under the front winder drum area.

A still further advantage of the present invention is that it provides a winder core loading arm that affords one more convenient placement for loading the cores into the loading arm.

A still further advantage of the present invention is that it provides a winder core loading arm that, depending on the location of the intermediate link, can vary the angular rotation of the arm.

Additional advantages and features of the present invention are described in, and will be apparent from, the detailed description of the presently preferred embodiments and the drawings.

DETAILED DESCRIPTION OF THE PRESENTLY PREFERRED EMBODIMENTS

The present invention relates to an apparatus for winding paper and like materials, and more specifically, to the winder core loading arm of such an apparatus. The winder core loading arm functions, in part, to load cores between two rolls so that paper and like product can be wound around the cores. To this end, the present invention provides an improved winder core loading arm having a less bulky mechanism as well as an extended range of rotation.

Figure 1:
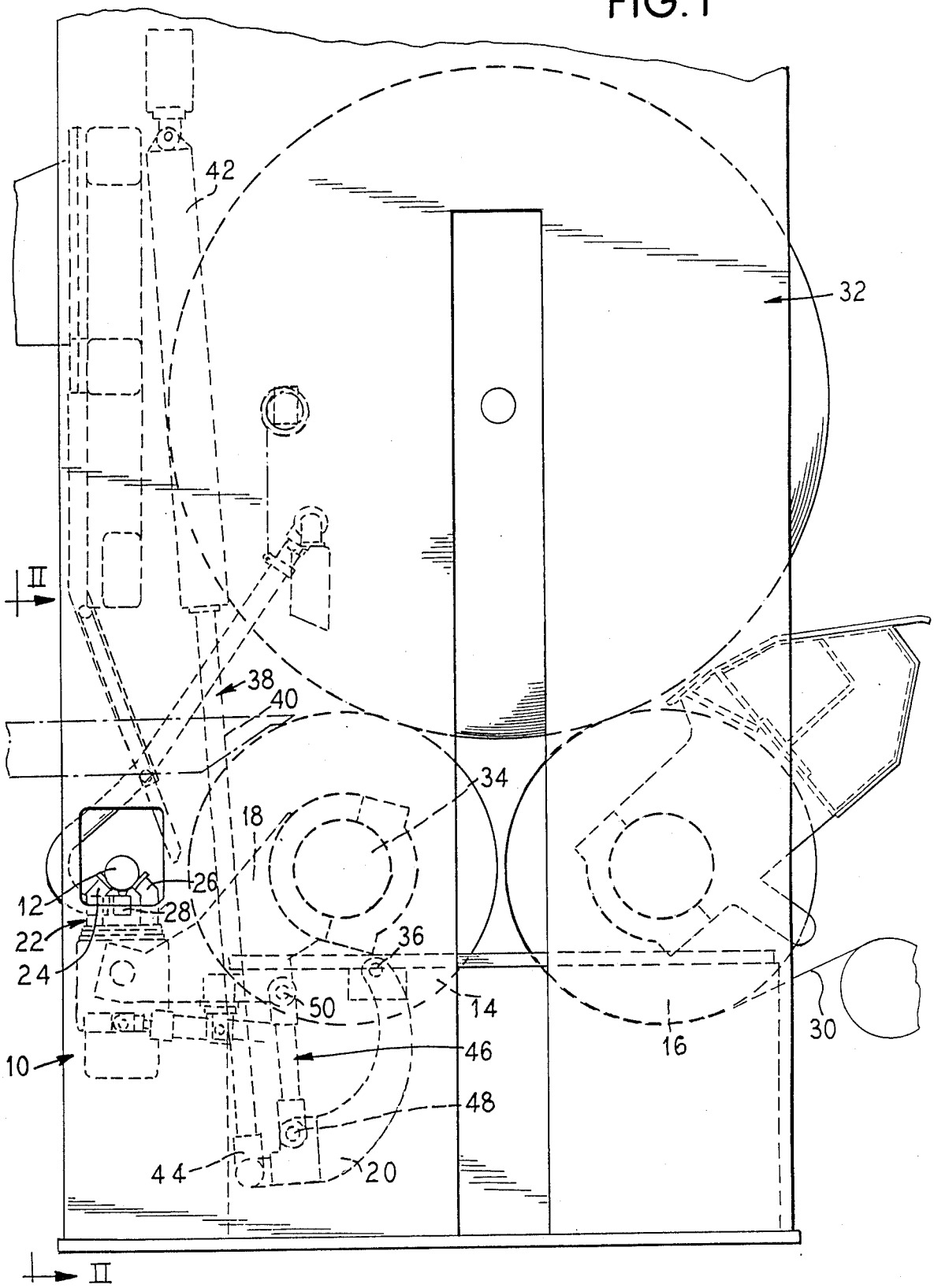
FIG. 1 illustrates a cross-sectional perspective view of a portion of paper winding apparatus having an embodiment of the winder core loading arm of the present invention.
Figure 2:
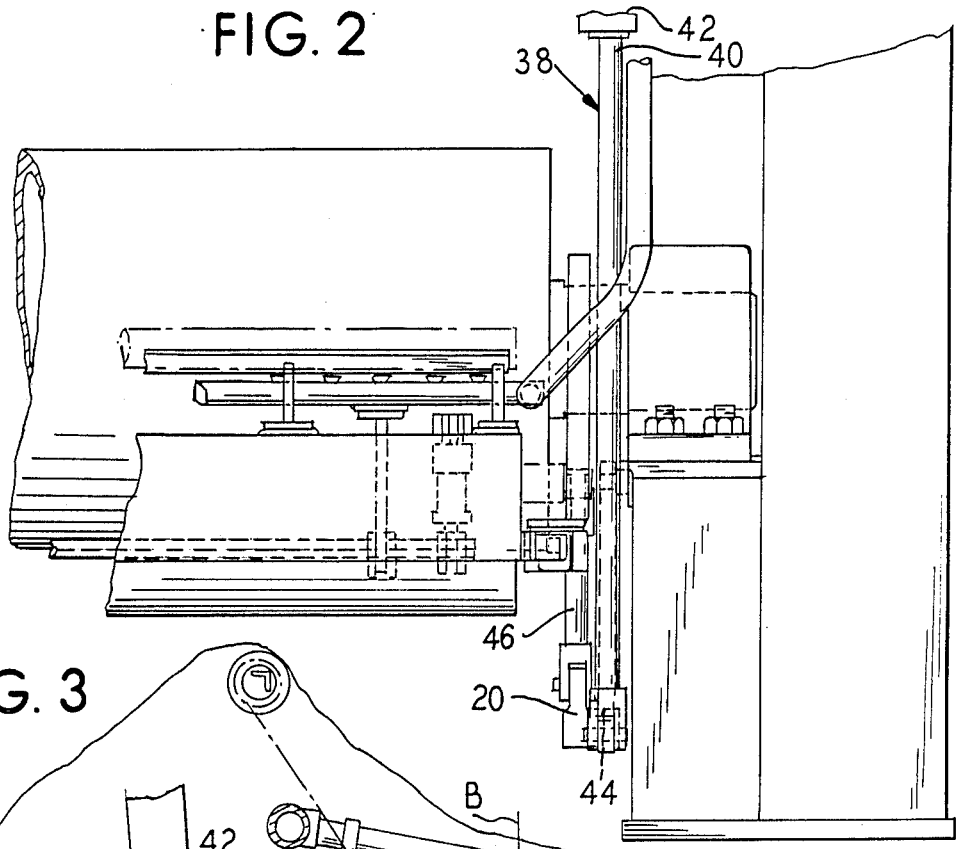
FIG. 2 illustrates a cross-sectional view taken along lines II—II of FIG. 1.
Figure 3:
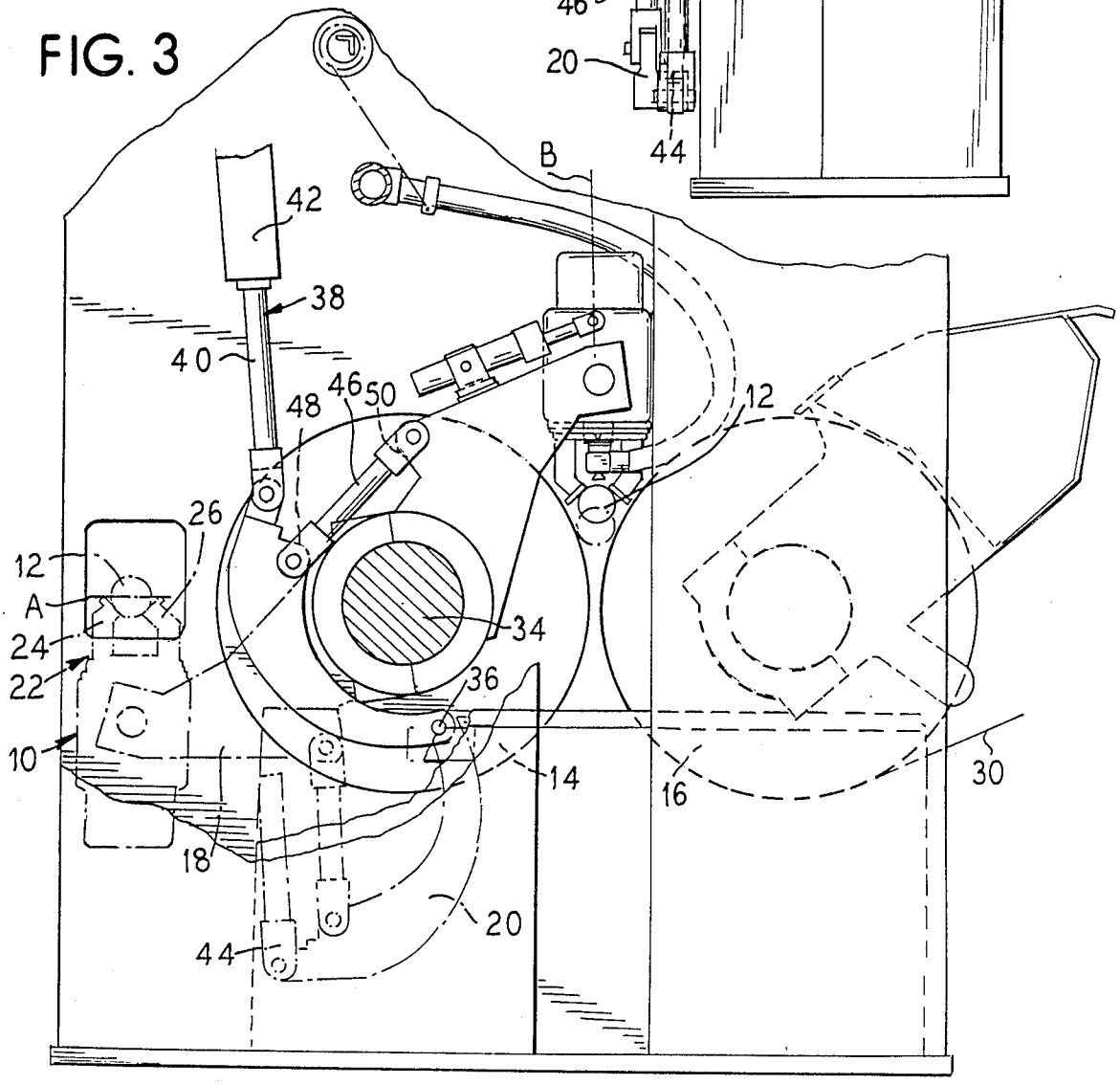
FIG. 3 illustrates the winder core loading arm of FIG. 1 illustrating in phantom lines a core being placed in the winder core loading arm and illustrating, in solid lines, a core being deposited between the two rolls by the winder core loading arm.

Referring now to FIGS. 1–3, an embodiment of the winder core loading arm 10 of the present invention is illustrated. As discussed below, the winder core loading arm 10 functions to place a core 12 between winder rolls 14 and 16 of the apparatus for winding paper. It will be recognized by those skilled in the art that a winder of the type illustrated most frequently will be located following a slitter, and a plurality of cores 12 in end-to-end arrangement will be placed between the winder rolls 14 and 16. For simplicity, a single core 12 is illustrated and will be referred to hereinafter.

The winder core loading arm 10 includes a primary arm 18 and a curved secondary arm 20. The primary arm 18 is secured to a mechanism 22 for loading and holding the core 12. The mechanism 22 includes two legs 24 and 26 constructed to support the core 12 and means 28 for holding the core 12 on the legs 24 and 26.

In the embodiment illustrated in FIG. 1, the means 28 for holding the core 12 on the legs 24 and 26 is a suction device that functions to exert a vacuum force against the core 12 pulling it against the legs 24 and 26 when the core loading arm is in the core loading position, as illustrated in FIG. 1, and when the core loading arm is in the core unloading position as illustrated in the solid lines of FIG. 3, the vacuum level on the suction device is relieved, releasing the core from the means for holding the core into place between the first roll 14 and the second roll 16.

To create a roll of paper or like material, paper 30 is fed around the second roll 16, and when the core is positioned between the rolls 14 and 16, as illustrated in FIGS. 1 and 3, around the core 12 to create a roll of paper 32. After the roll 32 has become sufficiently large, the roll of paper 32 is moved and a new core is loaded between the rolls 14 and 16.

As previously stated, the winder core loading arm 10 includes a primary arm 18 and a curved secondary arm 20. The primary arm 18 is secured to the stand for first roll 14 at a pivot point 34. Accordingly, the primary arm 18 can rotate about the pivot point 34. The curved secondary arm 20 is also secured to the stand for first roll 14 at a pivot point 36. Likewise, accordingly, the curved secondary arm 20 can rotate about the pivot point 36.

To move the winder core loading arm 10 from a loading position illustrated in FIG. 1 to a core unloading position illustrated in the solid line of FIG. 3, a lift rod 38 is provided. The lift rod 38 comprises, preferably, a piston cylinder. To this end, the lift rod 38 comprises a piston rod 40 that is received within a cylinder 42. The lift rod 38 is preferably hydraulic, but can be actuated by some other means known in the art. It should be recognized that the lift rod and cylinder arrangement will be provided on both the front and back sides of the winder in a typical installation.

The lift rod 38 is secured at one of its ends to the curved secondary arm 20 by a unit rod connection 44. The unit connection secures an end of the piston rod 40 to the curved secondary arm 20. Accordingly, as the lift rod 38 is actuated, through a piston motion, the unit rod 38 causes the curved secondary arm 20 to be pulled upwardly toward the cylinder 42 lift rod.

In order to move, and thereby rotate, the primary arm 18, the curved secondary arm 20 is secured to the primary arm 18 by an intermediate link 46. To this end, one end 48 of the intermediate linked 46 is secured to the curved secondary arm 20 and a second end 50 of the intermediate link 46 is secured to the primary arm 18. The intermediate link 46 is a rigid member that provides a mechanical advantage.

When the lift rod 38 is actuated, causing the piston rod 40 to be withdrawn into the cylinder 42, the curved secondary arm 20 is pulled upwardly. Because of the intermediate link 46 the primary arm 18 is caused to rotate about the pivot point 34 as the secondary arm 20 is rotated by the lift rod 38. This rotation is illustrated in FIG. 3, the broken lines illustrate the primary arm 18 in the core 12 loading position and the solid lines illustrate the primary arm in the core unloading position.

It should be noted that the intermediate link 46 can be secured between the secondary arm 20 and the primary arm 18 at different positions on the primary arm 18 and/or secondary arm 20. Moreover, the length of the intermediate length 46 can be varied. By varying the position and the length of the intermediate link 46 between the primary arm 18 and the secondary arm 20, one can vary the angular rotation of the winder core loading arm 10.

For example, with the intermediate link 46 positioned between the primary arm 18 and the curved secondary arm 20 as illustrated in FIG. 3, the winder core loading arm 10 can rotate from point A to point B, i.e., the core loading position and the core unloading position, an arc of approximately 156°. As stated in the background of the invention, heretofore, winder core loading arms traditionally only were rotatable through an arc of approximately 110°. Accordingly, the intermediate link 46 can vary the angular rotation of the winder core loading arm 10.

Figure 4:
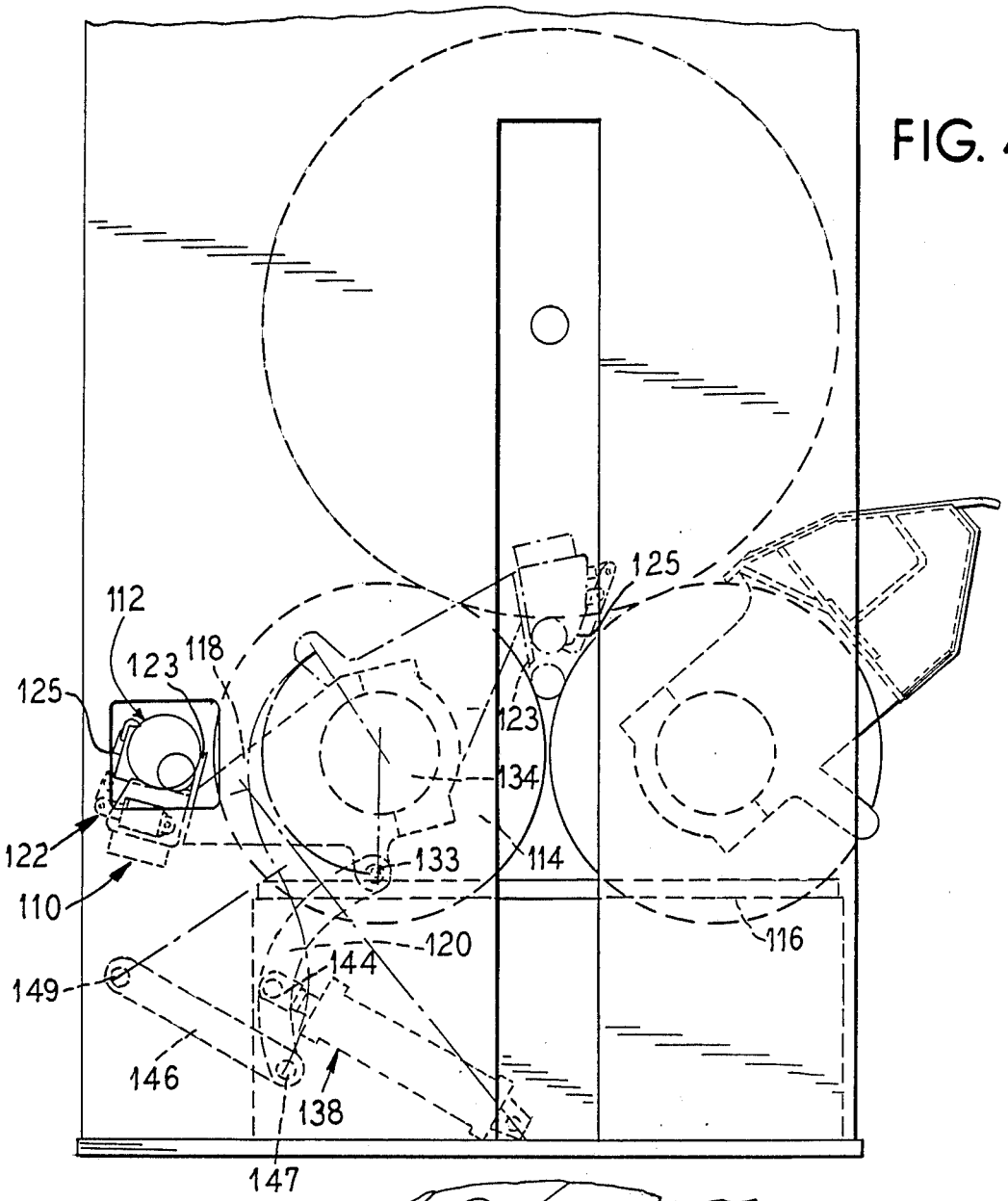
FIG. 4 illustrates a cross-sectional perspective view of another embodiment of the winder core loading arm of the present invention.
Figure 5:
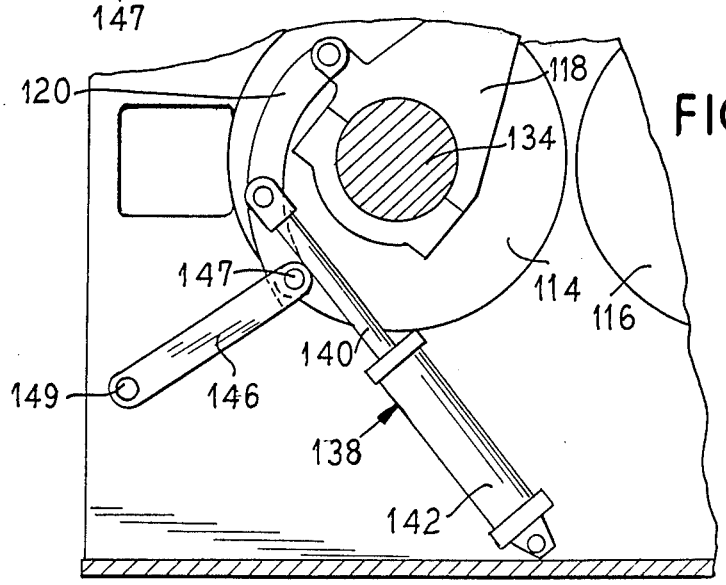
FIG. 5 illustrates the winder core loading arm of FIG. 4 when the cores are being placed in between the rolls of a paper winding machine by the winder core loading arm.

Referring now to FIGS. 4 and 5, another embodiment of the winder core loading arm 110 of the present invention is illustrated. Again, the winder core loading arm 110 includes a primary arm 118 and a curved secondary arm 120. The primary arm 118 includes means 122 for holding the core 112 so that it can be positioned between the two rolls 114 and 116 of apparatus for winding paper. The means 122 for holding the core 112 comprise a fixed leg 123 against which the core 112 rests and a movable leg 125 that clamps the core 112 against the fixed leg 123, as illustrated in FIG. 4. When the core winder arm 110 is in the core unloading position, i.e., the position for loading the core 112 between the rolls 114 and 116, the movable leg 125 is moved away from the core 112 allowing the core to drop between the two rolls 114 and 116.

Again, the primary arm 118 is pivotally connected to the stand for roll 114 at a pivot point 134. Accordingly the primary arm 118 can rotate about the pivot point 134. In this embodiment of the present invention, however, the curved secondary arm 120 is pivotally connected to the primary arm 118 at pivot point 133. Accordingly, the curved secondary arm 120 can rotate about the pivot point 133.

In this embodiment of the invention, the actuator 138 that actuates the winder core loading arm 110 is secured to the curved secondary arm 120 at a unit rod connection 144. The actuator 138 includes an actuator rod 140 and cylinder 142. As illustrated in FIG. 5, as the actuator rod 140 is extended, it causes the curved secondary arm 120 to move upwardly rotating the primary arm 118. In order to accomplish such rotation of the primary arm 118, an intermediate link 146 is secured to an end of the curved secondary arm 120 at point 147. The intermediate link 146 is also secured at a pivotal point 149 to the structure of the paper winder apparatus.

Again, the construction and arrangement of the primary arm 118, secondary arm 120, intermediate link 146, and actuator rod 138, affords the winder core loading arm 110 a great annular rotation than previous winder core loading arms. By varying the position of the connection of the intermediate link 146 to the curved secondary arm 120 as well as the position of the actuator rod 140 to the curved secondary arm 120, one is able to vary the extent of the angular rotation of the winder core loading arm 110.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A rotatable core loading arm for loading a core in a paper winding machine having a roll and a roll stand, said core loading arm comprising:

a primary arm including means for holding a core, the primary arm being pivotally coupled to the roll stand of the paper winding machine;

a secondary arm having a pivotal connection to the roll stand of the paper winding machine and a pivotal connection to means for moving the second arm; and an intermediate link means secured to the secondary arm for creating a mechanical advantage causing the primary arm to rotate through an arc greater than the arm moved through by the secondary arm as the secondary arm is moved by the means for moving.

2. The rotatable core loading arm of claim 1 wherein the secondary arm is pivotally connected to the roll stand of the paper winding machine at a first end thereof and coupled to the means for moving at a second end thereof.

3. The rotatable core loading arm of claim 1 wherein the intermediate link means is pivotally secured at a first end thereof to the secondary arm and secured at a second end thereof to the primary arm.

4. The rotatable core loading arm of claim 1 wherein the means for moving is a timed lift rod.

5. The rotatable core loading arm of claim 1 wherein the secondary arm is pivotaally coupled at one end to the primary arm and at a second end to the intermediate link.

6. The rotatable core loading arm of claim 1 wherein the secondary arm is pivotally secured to the roll stand of the paper winding machine.

7. The rotatable core loading arm of claim 5 wherein the intermediate link means is coupled at one end to the secondary arm and at a second end to a part of the paper winding machine not including the primary arm.

8. The rotatable core loading arm of claim 1 wherein the secondary arm is curved.

9. A rotatable core loading arm for loading a core in a paper winding machine having at least one winding roll and a roll stand, the core loading arm comprising:

a primary arm including at a first end thereof means for holding a core, the primary arm being pivotally secured to the roll stand of the paper winding machine;

a curved secondary arm pivotally secured at one end to the rolls stand of the paper winding machine, the secondary arm being secured to means for moving the secondary arm; and an intermediate link, secured at one end to the secondary arm and at a second end to the primary arm, for causing the primary arm to rotate through a greater arc than the secondary arm as the secondary arm is moved.

10. The rotatable core loading arm of claim 9 wherein the secondary arm is secured at a second end to the means for moving the secondary arm.

11. The rotatable core loading arm of claim 9 for a paper winding machine having two winding rolls wherein the primary arm is rotatable from a first position wherein the core is loaded into the means for holding the core to a second position where in the core is unloaded between the winding rolls.

12. The rotatable core loading arm of claim 11 wherein the first end of the primary arm is moved through an arc of at least approximately 150° when the primary arm is moved from the first position to the second position.

13. The rotatable core loading arm of claim 9 wherein the means for moving is an actuator.

14. A rotatable core loading arm for loading a core in a paper winding machine having at least one winding roll and a roll stand, the core loading arm comprising:

a primary arm including, located at a first end thereof, means for holding a core, the primary arm being pivotally connected to the roll stand of the paper winding machine;

a curved secondary arm pivotally connected at a first end thereof to the primary arm and secured to a means for moving the secondary arm; and an intermediate link secured at one end thereof to the curved secondary arm and at a second end thereof to a part of the paper winding machine for causing the curved secondary arm to rotate the primary arm as the secondary arm is moved by the means for moving the secondary arm.

15. The rotatable core loading arm of claim 14 wherein said paper winding machine has two winding rolls, and wherein the first end of the primary arm is rotatable from a first loading position to a second position wherein the core is unloaded between said winding rolls of the paper winding machine, the primary arm rotating through an arc of at least approximately 150° in rotating from the first position to the second position.

16. The rotatable core loading arm of claim 14 wherein the intermediate link is secured to a second end of the secondary arm.

17. The rotatable core loading arm of claim 14 wherein the means for moving is secured at a position on the secondary arm between the position wherein the intermediate link is secured to the secondary arm and the secondary arm is secured to the primary arm.

18. The rotatable core loading arm of claim 14 wherein the means for moving includes a piston rod and cylinder.

* * * * *

UNITED STATES PATENT AND TRADEMARK OFFICE

CERTIFICATE OF CORRECTION

PATENT NO. : 4,826,095

DATED : May 2, 1989

INVENTOR(S) : Frank J. Wywialowski

It is certified that error appears in the above-identified patent and that said Letters Patent is hereby corrected as shown below:

Column 5, line 36, Claim 3, insert --pivotally-- before "secured".

Column 5, line 41, Claim 5, delete "pivotaally" and insert therefor --pivotally--.

Column 6, line 2, Claim 9, delete "rolls" and insert therefor --roll--.

Signed and Sealed this

Twelfth Day of December, 1989

*Attest:*

JEFFREY M. SAMUELS

*Attesting Officer*

*Acting Commissioner of Patents and Trademarks*